US008811875B2

(12) United States Patent
Yamana

(10) Patent No.: US 8,811,875 B2
(45) Date of Patent: Aug. 19, 2014

(54) FIXING DEVICE INCLUDING MEANDER REGULATING MEMBER AND IMAGE FORMING APPARATUS

(75) Inventor: Shinji Yamana, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/567,171

(22) Filed: Aug. 6, 2012

(65) Prior Publication Data

US 2013/0058689 A1 Mar. 7, 2013

(30) Foreign Application Priority Data

Sep. 7, 2011 (JP) ..... 2011-194625

(51) Int. Cl.
*G03G 15/20* (2006.01)

(52) U.S. Cl.
CPC .. *G03G 15/2053* (2013.01); *G03G 2215/00143* (2013.01); *G03G 2215/2022* (2013.01)
USPC ..... 399/329

(58) Field of Classification Search
CPC ..... G03G 2215/2022; G03G 2215/2016; G03G 2215/2035; G03G 2215/00143; G03G 2215/00121; G03G 15/755
USPC ..... 399/329, 330, 328, 67, 122
See application file for complete search history.

(56) References Cited

U.S. PATENT DOCUMENTS

| | | | |
|---|---|---|---|
| 8,447,218 B2 | 5/2013 | Yamana | |
| 2012/0051808 A1 | 3/2012 | Yamana | |

FOREIGN PATENT DOCUMENTS

| | | | | |
|---|---|---|---|---|
| JP | 57-70238 U | | 10/1980 | |
| JP | 57-07238 U | * | 4/1982 | |
| JP | 10227342 A | * | 8/1998 | ..... F16H 7/00 |
| JP | 2009-069478 A | | 4/2009 | |
| JP | 2009-151260 A | | 7/2009 | |
| JP | 2011-053509 | | 3/2011 | |
| JP | 2011053509 A | * | 3/2011 | |
| JP | 2011-123382 A | | 6/2011 | |

OTHER PUBLICATIONS

Notification of Reasons for Refusal for corresponding Japanese Application No. 2011-194625 dispatched on Jul. 9, 2013 with English translation.

* cited by examiner

*Primary Examiner* — Billy Lactaoen
(74) *Attorney, Agent, or Firm* — Renner, Otto, Boisselle & Sklar, LLP

(57) ABSTRACT

A pair of meander regulating rollers are disposed on the paper input side at both the longitudinal ends of a fixing roller. If a fixing belt moves off to one side end from the correct position, the meander regulating roller arranged on the one side end presses the fixing belt so as to produce a force of moving the belt to the other side end, whereby the fixing belt is stabilized in a state where the belt is held by the meander regulating roller on the one side end. On the other hand, if the fixing belt moves off to the opposite side end due to uneven temperature distribution, imbalance nip load or the like in the axial direction, it is possible to restrain the meandering in a similar manner by means of the meander regulating roller on the other side end.

2 Claims, 7 Drawing Sheets

FIXING DEVICE INCLUDING MEANDER REGULATING MEMBER AND IMAGE FORMING APPARATUS

This Nonprovisional application claims priority under 35 U.S.C. §119 (a) on Patent Application No. 2011-194625 filed in Japan on 7 Sep. 2011, the entire contents of which are hereby incorporated by reference.

BACKGROUND OF THE INVENTION (1) Field of the Invention

The present invention relates to a fixing device which heats and fixes toner onto recording paper as well as relating to an image forming apparatus using the same fixing device.

(2) Description of the Prior Art

Electrophotographic image forming apparatus for forming images based on electrophotography (which will be simply called "image forming apparatus" hereinbelow) can easily produce images of high quality. The image forming apparatus has been widely used for copiers, printers, facsimile machines, multi-functional machines and others. The image forming apparatus includes, for example a photoreceptor, a charging unit, a light exposure unit, a developing unit, a transfer unit and a fixing unit. The image forming apparatus performs the steps of charging, light exposure, developing, transfer and fixing, by means of these components. The image forming apparatus is an apparatus that forms images on recording paper.

As the fixing unit for performing the step of fixing, a fixing device using a belt fixing mechanism has been used for example. The fixing device of a belt fixing mechanism includes a heat roller, a fixing belt, a fixing roller and a pressing roller. The fixing roller and pressing roller are a pair of rollers that press each other with a fixing belt in-between. The heat roller includes a heat source such as a halogen heater or the like as heating equipment therein.

For prevention against meandering of the fixing belt (moving in the longitudinal direction of the heating roller and fixing roller), generally, rotatable move-off stoppers are provided for the heat roller so as to abut the side edges of the fixing belt, to restrain the meandering of the belt. Further, as shown in patent document 1, there is an invention of a method for actively controlling a meandering belt by changing the position of a roller based on a belt meander sensor so as to cancel belt meandering.

Patent Document 1:

Japanese Patent Application Laid-open 2011-123382

However, in the above active control, a sensor for detecting belt meandering, a control circuit and a device for controlling the position of the roller that suspends the belt are needed, thus posing a problem of making the fixing device more complicated and increased in cost.

SUMMARY OF THE INVENTION

It is therefore an object of the present invention to provide a fixing device that can autonomously regulate the meandering of a fixing belt as well as providing an image forming apparatus using the fixing device.

In order to achieve the above object, the present invention is configured as follows:

A fixing device according to the present invention, comprises: an endless fixing belt that is put in contact with a toner image on a fixed medium and fixes the toner image to the fixed medium; a heat roller for heating the fixing belt; a fixing roller that suspends the endless fixing belt between the heat roller and itself and has a silicone rubber layer that comes into pressing contact with the toner image on the fixed medium via the fixing belt; a pressing roller that presses the fixing roller via the fixing belt; and, a meander regulating member that presses the fixing belt against the fixing roller from the paper input side, at the side end of the fixing belt on the side to which the fixing belt is moved off with respect to the longitudinal direction of the fixing roller.

The fixing device is also characterized in that the meander regulating member is disposed at either end of the fixing roller with respect to the longitudinal direction, so that at least one of the side ends of the fixing belt abut the meander regulating member.

The fixing device is further characterized in that the meander regulating member is a rotatable roller.

Moreover, the fixing device is characterized in that the meander regulating members have a counter-tapered shape that becomes wider as it goes to either axial end.

Finally, an image forming apparatus of the present invention is characterized by including the fixing device described above.

Belt meandering takes place when the heat roller, the fixing belt, the fixing roller and the pressing roller, which all should be parallel to each other, become inclined so that their rotational axes intersect. For example, if, in the nip portion where the fixing roller and the pressing roller come into pressing contact with each other with the fixing belt therebetween, the pressing roller is inclined relative to the fixing roller, the fixing belt is pulled in the rotational direction of the pressing roller, resultantly meanders. That is, compared to the inclination of the heat roller, the pressing force in the nip portion is greater, hence the force causing meander is greater. Accordingly, making the fixing belt produce a force that cancels belt meandering in the nip portion is effective in restraining belt meandering.

When the fixing system is driven by the pressing roller, the fixing belt receives a rotational force through the nip portion of the pressing roller only. Accordingly, the rotational motion of the fixing belt is braked on the paper output side after its passage through the nip, so that the fixing belt becomes slightly slack on the paper output side. Now, when the fixing belt is pressed from the paper input side, the fixing belt slacks on the upstream side of the pressed position. When the slack due to this pressing is created on one side of the length of the fixing belt only, the other side of the fixing belt slacks on the paper output side while the first side slacks on the paper input side. This state is equivalent to a condition where the first side and the other side of the fixing roller are inclined in the nip portion, upstream and downstream, respectively with respect to the rotational direction of the fixing belt, which causes the fixing roller to produce a force of pulling the fixing belt to the first side so as to be able to move the fixing belt to the other side.

In this way, the side end of the fixing belt to which the fixing melt is moved off with respect to the length of the fixing roller is pressed against the fixing roller, whereby it is possible to restrain belt meandering.

Further, since the meander regulating members are pressed against and fixed at both ends of the fixing roller, if, for example, the fixing belt moves off to one side, the fixing belt abuts the meander regulating member disposed on that side so that the fixing belt is pulled to the opposite side by the function of the meander regulating member, and stops moving at a position where a state of equilibrium is reached. In this way, the meandering of the fixing belt can be automatically regulated without any sensor or any control circuit.

Further, since the meander regulating member is made of a rotatable roller, it is possible to alleviate abrasion against the fixing belt surface and still produce the effect of meander regulation.

Moreover, as the meander regulating roller presses the fixing belt in order to regulate belt meandering, the belt surface may warp near the area being pressed while the belt is rotating. If the meandering force is strong and the pressing force for meander regulation is strong, the belt surface may be wrinkled. This can be prevented by setting so that the load of the meander regulating roller acting on the fixing belt will change gently. To achieve this, by forming the meander regulating rollers in a tapered shape so that the farther in the longitudinal direction the fixing belt moves off, the stronger the pressing force is applied, the warp of the fixing belt can be alleviated and the belt become unlikely to wrinkle.

DESCRIPTION OF THE PREFERRED EMBODIMENTS

Figure 1:
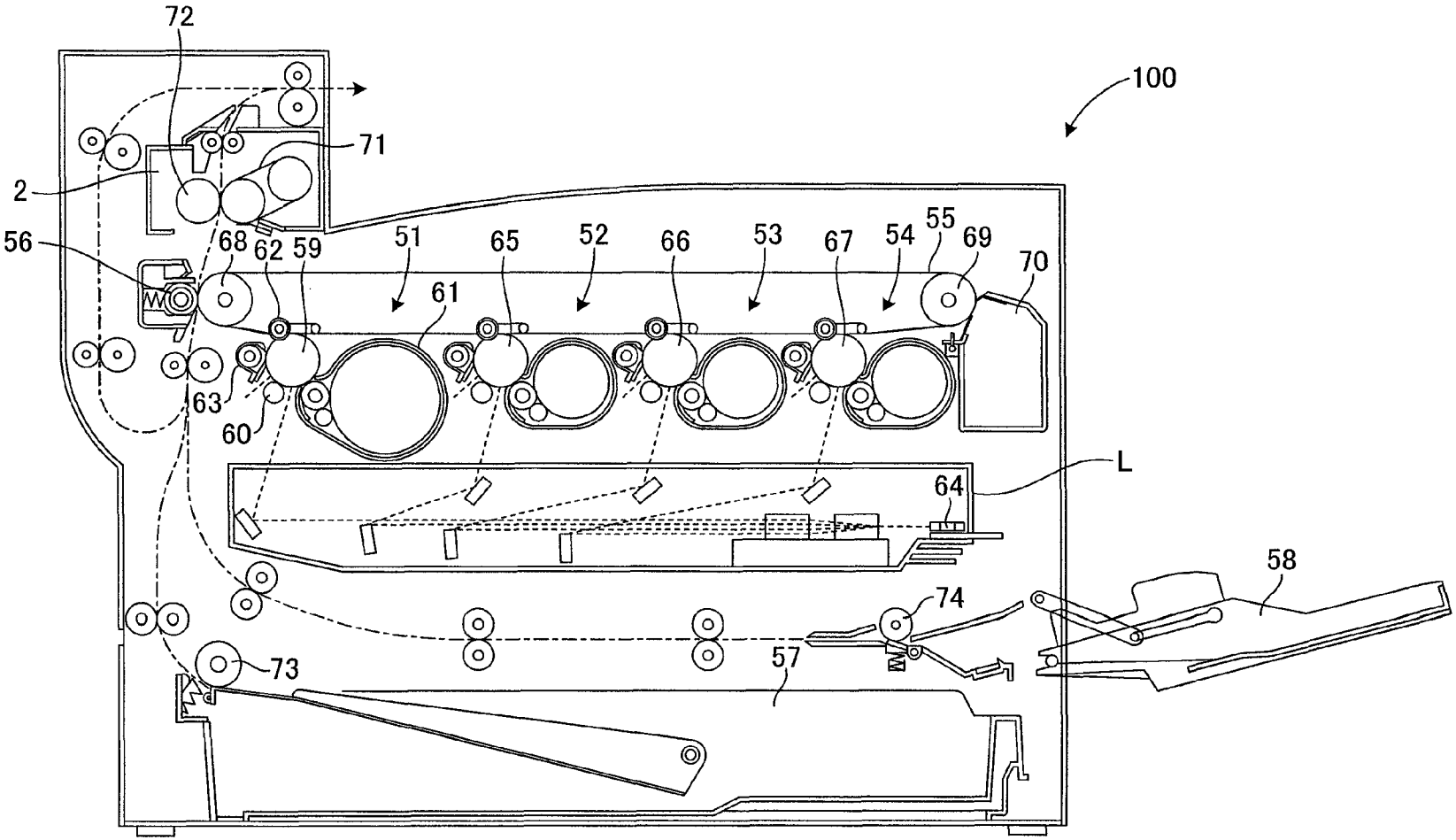
FIG. 1 is an overall diagram schematically showing an image forming apparatus having a fixing device according to the embodiment of the present invention.

Now, the embodiment of the present invention will hereinafter be described with reference to the accompanying drawings.

In the description hereinbelow, there are cases where the items having been described in the preceding mode are allotted with the same reference numerals and repeated description is omitted. It is assumed that when only part of the whole configuration is described, the rest of the configuration is the same as those given in the precedent description. Other than the specifically described combination of components in each embodiment, different embodiments may be partially combined as long as no particular hindrance occurs in the combination. Further, each embodiment is a mere example to embody the technology of the present invention, and should not limit the technical scope of the present invention. Concerning the technical description according to the present invention, various changes and modifications can be made in the technical range specified in the scope of claims.

(Explanation of Image Forming Apparatus)

FIG. 1 is an overall diagram schematically showing an image forming apparatus having a fixing device according to an embodiment of the present invention. This is an example where an image forming apparatus 100 is applied to a color multifunctional machine.

Color multifunctional machine 100 of the embodiment of the present invention includes: first to fourth visual image forming units 51, 52, 53 and 54; an intermediate transfer belt 55; a secondary transfer unit 56; a fixing unit 2; an internal paper feed unit 57; and a manual paper feed unit 58.

First to fourth visual image forming units 51, 52, 53 and 54, intermediate transfer belt 55 and secondary transfer unit 56 form a toner image forming assembly.

First visual image forming unit 51 includes a photoreceptor 59, a charging unit 60, an optical unit L, a developing unit 61, a primary transfer unit 62. These units form a toner image on photoreceptor 59, which is transferred to intermediate transfer belt 55.

In first visual image forming unit 51, charging unit 60, developing unit 61 and a cleaning unit 63 are laid out around photoreceptor 59 as an image bearer.

Optical unit L is arranged so as to lead light beams based on image information from a light source 64 to four sets of photoreceptors 59, 65, 66 and 67.

Primary transfer unit 62 is arranged in pressing contact with photoreceptor 59 with intermediate transfer belt 55 therebetween.

Since the other second to fourth visual image forming units 52, 53 and 54 have the same configuration as that of first visual image forming unit 51, description of these is omitted. The developing units of units 54, 53, 52 and 51 accommodate different color toners, i.e., yellow (Y), magenta (M), cyan (C) and black (B) toners, respectively.

The toner images of the above-described different colors are transferred to intermediate transfer belt 55 to thereby form a color toner image. Intermediate transfer belt 55 is wound without a slack between tension rollers 68 and 69 while a waste toner box 70 is abutted against the belt on the tension roller 69 side.

Secondary transfer unit 56 transfers the color toner image formed on intermediate transfer belt 55 to a sheet of paper. Secondary transfer unit 56 is arranged and abutted against tension roller 68.

Fixing unit 2 has a fixing member 71 and a pressing member 72, further having an unillustrated pressing part, which makes fixing member 71 and pressing member 72 press each other with a predetermined pressure. Fixing unit 2 is disposed downstream side of secondary transfer unit 56 with respect to the flowing direction of the paper.

Next, the image forming process using image forming apparatus 100 will be illustrated.

Taking an example of first visual image forming unit 51, the photoreceptor 59 surface is uniformly charged by charging unit 60, then is exposed to laser light from optical unit L in accordance with image information to form an electrostatic latent image.

As charging unit 60, a charge roller type is adopted in order to uniformly charge the photoreceptor 59 surface while suppressing generation of ozone gas as much as possible.

The electrostatic latent image on photoreceptor 59 is developed with toner by means of developing unit 61. The thus visualized toner image is transferred to intermediate transfer belt 55 by primary transfer unit 62 which is applied with a bias voltage of a polarity opposite to that of the toner.

The other three, second to fourth visual image forming units 52, 53 and 54 also operate in the same manner so that the resultant toner images are successively transferred to intermediate transfer belt 55.

The toner image on intermediate transfer belt 55 is conveyed up to secondary transfer unit 56. On the other hand, a recording sheet that has been fed by paper feed roller 73 of internal paper feed unit 57 or paper feed roller 74 of manual paper feed unit 58 is also conveyed to secondary transfer unit 56. The secondary transfer unit 56 is applied with a bias voltage of a polarity opposite to that of the toner, so that the toner image is transferred from intermediate transfer belt 55 to the recording paper while the paper passes through secondary transfer unit 56. The recording paper carrying the transferred toner image thereon is conveyed to fixing unit 2, and fully heated by means of the fixing roller and pressing roller as will be detailed below, so that the toner image is fused and fixed to the recording paper, which is then discharged to the outside.

(Description of Belt Fixing)

Figure 2:
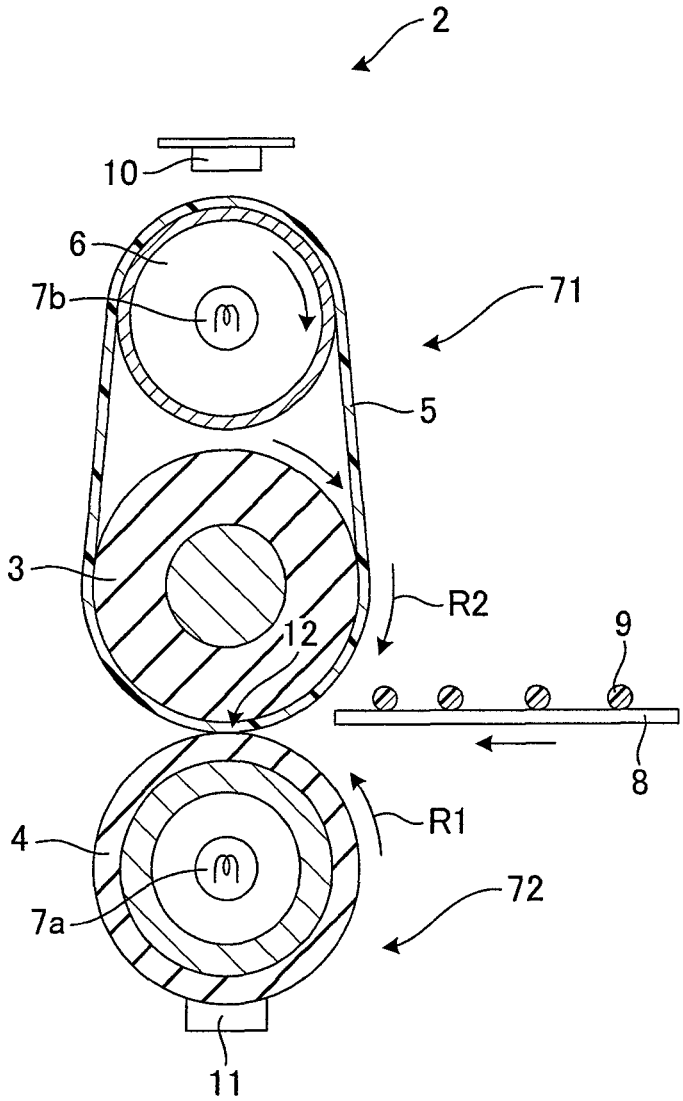
FIG. 2 is a sectional view schematically showing a configuration of a fixing device according to the embodiment of the present invention.

FIG. 2 is a sectional view schematically showing a configuration of fixing device 2 according to the embodiment of the present invention.

Fixing device 2 included in image forming apparatus 100 includes fixing member 71 and pressing member 72.

Figure 3A:
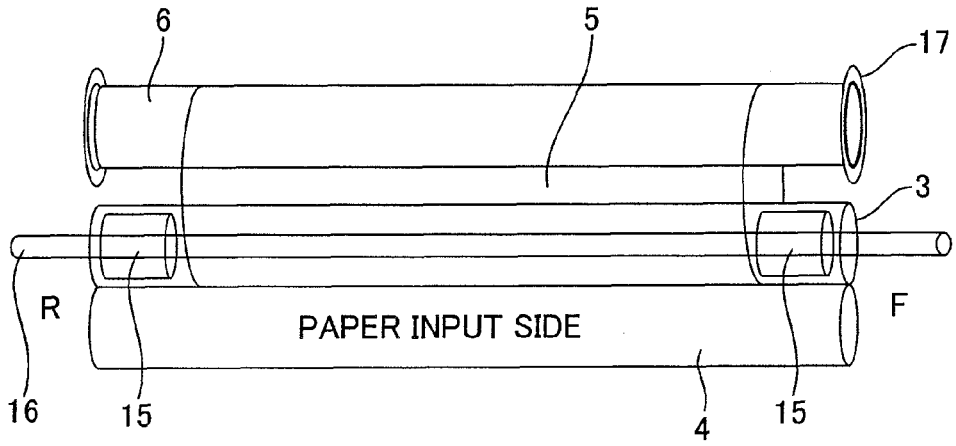
FIG. 3A is a schematic perspective view showing a fixing device equipped with meander regulating rollers and FIG. 3B a schematic side view showing the fixing device equipped with meander regulating rollers.
Figure 3B:
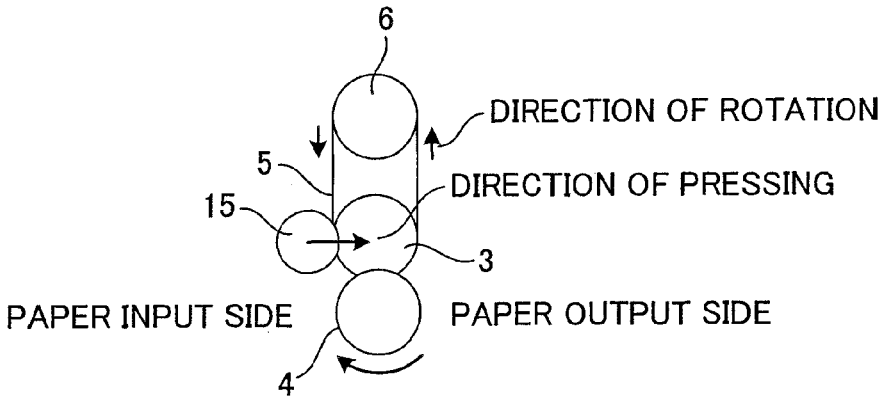

Fixing member 71 includes a fixing roller 3, an endless fixing belt 5, a heat roller 6 for suspending and heating fixing belt 5, a heater lamp 7*b* as a heat source for heating heat roller 6, a first thermistor 10 as a temperature sensor that configures a temperature detector for detecting the temperatures of fixing belt 5, pressing roller 4 and others, and an anti-meander regulating roller 15 (FIGS. 3A and 3B, detailed later).

Pressing member 72 includes a pressing roller 4, a heater lamp 7*a* as a heat source for heating pressing roller 4 and a second thermistor 11 as a temperature sensor that configures a temperature detector for detecting the temperature of pressing roller 4.

Fixing roller 3 has an approximately cylindrical shape, having a two-layered structure formed of a metal core and an elastic layer, from the central axis toward the outside periphery of the cylinder.

The metal core of fixing roller 3 is made of metal such as iron, stainless steel, aluminum, copper, an alloy of these, or the like.

For the elastic layer of fixing roller 3, elastic materials having heat-resistance such as silicone rubber, fluoro rubber are suitably used.

In the present embodiment, the diameter of fixing roller 3 is 50 mm. The metal core of fixing roller 3 has a diameter of 20 mm and is made of stainless steel. The elastic layer of fixing roller 3 is made of silicone rubber sponge of 15 mm thick.

Fixing roller 3 is arranged rotatably about the central axis of the approximate cylinder, and rotates following the rotation of pressing roller 4. Fixing roller 3 comes into pressing contact with pressing roller 4 via fixing belt 5 so as to form a fixing nip portion 12 in the area where fixing roller 3 and pressing roller 4 abut each other via fixing belt 5.

Pressing roller 4 has an approximately cylindrical shape, having a three-layered structure formed of a metal core, an elastic layer and a release layer, from the central axis toward the outside periphery of the cylinder.

The metal core of pressing roller 4 is made of metal such as iron, stainless steel, aluminum, copper, an alloy of these, or the like.

For the elastic layer of pressing roller 4, elastic materials having heat-resistance such as silicone rubber, fluoro rubber are suitably used.

For the release layer of pressing roller 4, fluoro resins such as PFA (copolymer of tetrafluoroethylene and perfluoroalkyl vinyl ether), PTFE (polytetrafluoroethylene) are suitably used.

In the present embodiment, the diameter of pressing roller 4 is 50 mm. The metal core of pressing roller 4 is an iron (STKM) pipe of 1 mm thick and 48 mm in diameter. The elastic layer of pressing roller 4 is made of silicone solid rubber of 1 mm thick. The release layer of pressing roller 4 uses a PFA tube of 50 μm thick.

Heater lamp 7*a* is disposed inside pressing roller 4 to heat pressing roller 4. The heater lamp is powered (supplied with electricity) from an unillustrated power source circuit under the control of an unillustrated control circuit so that the heater lamp 7*a* illuminates and radiates infrared rays.

The inner peripheral surface of pressing roller 4 absorbs infrared rays emitted from heater lamp 7*a* so that the entire pressing roller 4 is heated. In the present embodiment, a heater lamp having a rated power of 300 watts is used.

Pressing roller 4 is arranged rotatably about the central axis of the approximate cylinder.

Pressing roller 4 is a roller-shaped member that is rotated by means of a drive motor as an unillustrated driver. Fixing roller 3 comes into pressing contact with pressing roller 4 via fixing belt 5 so as to form fixing nip portion 12 and is passively driven to thereby convey fixing belt 5. Fixing roller 3 rotates in the direction opposite to that of pressing roller 4.

Fixing roller 3 and pressing roller 4 are pressed against each other with a predetermined load, e.g., 800 N. As fixing roller 3 and pressing roller 4 are pressed against each other, fixing nip portion 12 is created. In the present embodiment, the dimension of fixing nip portion 12 (which will be referred to hereinbelow as "nip width") in the direction of the recording paper's direction of conveyance is 11 mm. Recording paper 8 as a fixed material having an unfixed toner image is fed. As recording paper 8 passes through fixing nip portion 12, a toner image 9 is fixed to recording paper 8. When recording paper 8 passes through fixing nip portion 12, fixing belt 5 abuts the toner image formed surface of recording paper 8 while pressing roller 4 abuts the rear side of the toner image-formed surface of recording paper 8.

Fixing belt 5 has a diameter of 75 mm when it is not mounted. Fixing belt 5 is formed of a hollow cylindrical base made of a heat-resistant resin such as polyimide or the like, or metallic materials such as stainless steel and nickel, or the like.

Formed on the surface of the base of fixing belt 5 is an elastic layer that is made of an elastomeric material such as silicone rubber or the like that is excellent in heat resistance and elasticity.

Formed on the surface of the elastic layer of fixing belt 5 is a release layer that is made of a synthesized resin material, specifically fluoro resin such as, for example PFA or PTFE, which is excellent in heat resistance and releasability.

Fixing belt 5 has a three-layered structure of a base, elastic layer and release layer.

In the present embodiment, for the base of fixing belt 5 a polyimide film of 70 μm thick is used; for the elastic layer of fixing belt 5 a silicone rubber layer of 200 μm thick is used; and for the release layer of fixing belt 5 a PFA coating of 30 μm thick is used.

Fixing belt 5 heated to a predetermined temperature by heat roller 6 applies heat to recording paper 8 that has unfixed toner image 9 formed thereon while the recording paper is passing through the fixing nip portion 12.

Fixing belt 5 is suspended between heat roller 6 and fixing roller 3.

Fixing belt 5 is driven following the rotation of fixing roller 4 and rotates in the direction of arrow R2.

Pressing roller 4 rotates in the direction of arrow R1 while fixing belt 5 rotates in the direction or arrow R2 so that recording paper 8 is driven through fixing nip portion 12.

Heat roller 6 has an approximately cylindrical shape, having a three-layered structure formed of an infrared absorptive layer, a metal core and a protective layer, from the central axis toward the outside periphery of the cylinder.

The infrared absorptive layer of heat roller 6 is formed by applying and baking a heat-resistant paint including carbon on the inner side of the core metal.

The metal core of heat roller 6 is made of metal such as iron, stainless steel, aluminum, copper, an alloy of these, or the like.

For the protective layer of heat roller 6, fluoro resins such as PFA (copolymer of tetrafluoroethylene and perfluoroalkyl vinyl ether), PTFE (polytetrafluoroethylene) or the like are suitably used. The protective layer of heat roller 6 prevents the polyimide layer of fixing belt 5 and heat roller 6 from being abraded due to contact between fixing belt 5 and heat roller 6.

In the present embodiment, the diameter of heat roller 6 is 35 mm. A carbon black paint of 100 μm thick is coated as the infrared absorptive layer of heat roller 6. As the metal core of heat roller 6, a hollow aluminum pipe of 1 mm thick having a diameter of 35 mm is used. For the protective layer of heat roller 6, a PTFE coating of 50 μm thick is used.

Heater lamp 7*b* for heating heat roller 6 is arranged inside heat roller 6. The heater lamp 7*b* is powered (supplied with electricity) from an unillustrated power source circuit under the control of an unillustrated control circuit so that the heater lamp 7*b* illuminates and radiates infrared rays. The inner peripheral surface of heat roller 6 absorbs infrared rays radiated from heater lamp 7*b* so that the entire heat roller 6 is heated. In the present embodiment, a heater lamp 7*b* having a rated power of 1,600 watts is used. A predetermined load, e.g., 50 N is applied to heat roller 6 in the opposite direction to that directed from heat roller 6 to fixing roller 3. Since tension is applied to fixing belt 5, heat roller 6 rotates in accompany with rotation of fixing belt 5.

In order to restrain fixing belt 5 on fixing roller 3 from moving off the predetermined position with respect to the longitudinal direction of fixing roller 3 (which will be referred to hereinbelow as "belt meandering"), a pair of meander regulating rollers 15 (FIGS. 3A and 3B) are disposed so as to abut fixing roller 3 at both longitudinal ends thereof.

When each meander regulating roller 15 is specified to be 30 mm in diameter and 20 mm wide, it is possible to regulate belt meandering by abutting the roller with a load of about 100 N.

Meander regulating roller 15 may be a metal roller of aluminum, iron, SUS or the like, but is preferably formed of silicone sponge rubber which presents heat insulating properties and heat resistance because it does not take heat from fixing roller 3, hence does not spoil energy saving performance. When a sponge roller is used, it is preferable that the rubber sponge is specified to be 5 mm or less in thickness and have an Ascar C hardness of 30 or greater so as to keep the necessary pressing force because the pressing force lowers due to deformation of the sponge. Here, the Ascar C hardness is specified by the Society of Rubber Industry, Japan Standard.

Though in the present embodiment, meander regulating roller 15 is used, it is also possible to use a member such as a pad or the like that will not rotate. In this case, however, the unrotatable member can be used on the condition that the durability of the surface of fixing belt 5 can be maintained when the member is put in pressing contact with fixing belt 5. Use of a rotatable roller as in the present embodiment is preferable as a meander regulation member because of the advantages that abrasion against the fixing belt 5 surface can be alleviated when the member is put in pressing contact with fixing belt 5 and that the member can naturally draw the fixing belt into its nip with fixing roller 3 when the fixing belt has moved off.

(Explanation on Regulation of Belt Meandering)

Regulation of belt meandering will be described with reference to FIGS. 3A and 3B. Here, the right side in FIG. 3A corresponds to the front (F) side of image forming apparatus 100 while the left side in FIG. 3B corresponds to the rear (R) side of image forming apparatus 100.

As shown in FIG. 3A, meander regulating rollers 15 are disposed on the paper input side at both the longitudinal ends of fixing roller 3. For example, if fixing belt 5 moves off to the R (rear)-side or the left side in the figure, from the correct position with respect to the longitudinal direction of fixing roller 3, fixing belt 5 gets into the nip between fixing roller 3 and meander regulating roller 15 located on the R-side. As a result, due to the thickness of fixing belt 5, the meander regulating roller 15 displaces the R-side of fixing roller 3 relative to pressing roller 4. This displacement of fixing roller 3 on the R-side relative to pressing roller 4 produces a force of moving fixing belt 5 to the F (front)-side or the side opposite to the movement of meandering, so that fixing belt 5 becomes stable in the condition that the belt is held between the fixing roller and the R-side of meander regulating roller 15. On the other hand, if fixing belt 15 moves off to the opposite side (F-side) due to uneven temperature distribution, imbalance nip load or the like in the axial direction, it is possible to restrain meandering in a similar manner by means of the F-side meander regulating roller 15.

In the above way, the system is so configured that if fixing belt 5 meanders, a pair of meander regulating rollers 15 autonomously restrain belt meandering, hence the system is simple, high in reliability and low in cost compared to active control using a belt meander sensor.

Figure 4:
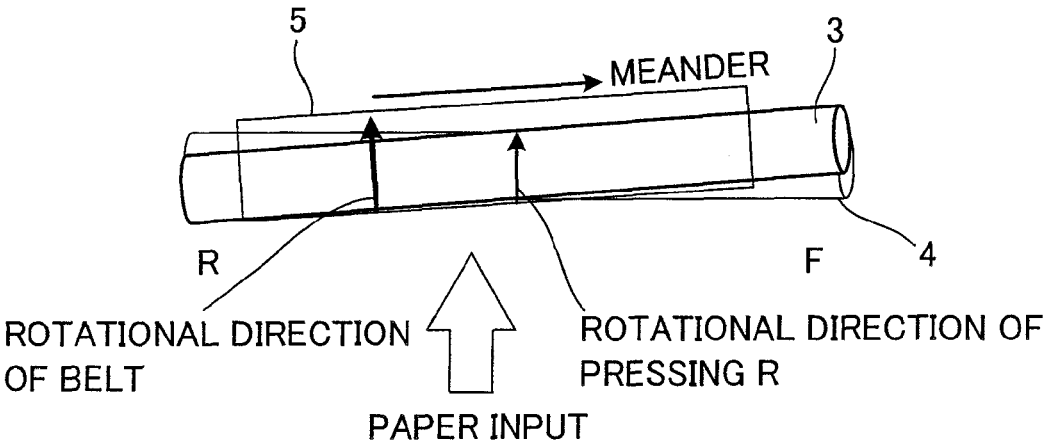
FIG. 4 is an illustrative view showing the meandering of a fixing belt.

Referring next to FIG. 4, belt meandering will be explained. Belt meandering takes place when the heat roller, fixing belt 5, fixing roller 3 and pressing roller 4, which all should be parallel to each other, become inclined so that the rotational axes of these intersect. For example, if, in the nip portion 12 where fixing roller 3 and pressing roller 4 come into pressing contact with each other with fixing belt 5 therebetween, the axis of pressing roller 4 is inclined relative to the axis of fixing roller 3, fixing belt 5 is pulled more in the rotational direction of pressing roller 4, on the side where fixing roller 3 and pressing roller 4 abut each other in the greater area, resultantly meanders. That is, compared to the inclination of heat roller 6 relative to fixing roller 3, the pressing force in the nip portion 12 is greater, hence the force causing meander is greater.

Accordingly, making fixing belt 5 produce a force that cancels belt meandering in nip portion 12 is effective in restraining belt meandering.

Figure 5A:
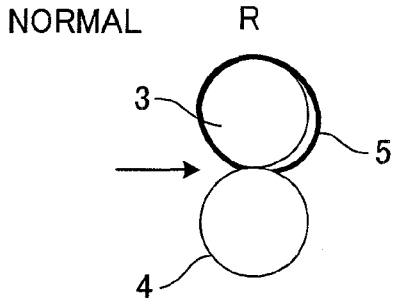
FIG. 5A is a side view showing normal belt meandering, FIG. 5B a side view showing meandering regulation when meander regulating rollers are provided, FIG. 5C a plan view showing meander regulation.
Figure 5B:
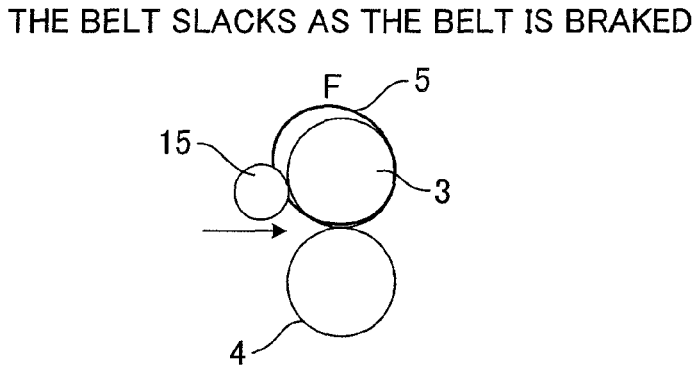
Figure 5C:
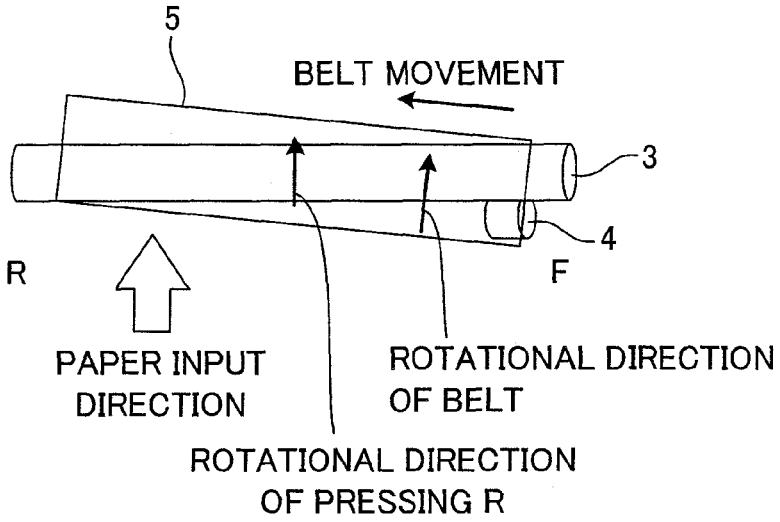

Referring now to FIGS. 5A to 5C, the principle of restraining belt meandering will be explained.

As shown in FIG. 5A, the fixing system is usually driven by pressing roller 4, hence fixing belt 5 receives its rotational force through the nip of pressing roller 4 only. Accordingly, the rotational motion of fixing belt 5 is braked on the paper output side after its passage through the nip, so that fixing belt 5 becomes slightly slack on the paper output side. Now, as shown in FIGS. 5B and 5C, when meander regulating roller 15 is pressed against fixing belt 5 from the paper input side, fixing belt 5 slacks on the upstream side of the pressed position (FIG. 5B). When the pressing force causing this slack is applied to fixing roller 3 on the front side (F-side) of its length only, the rear side (R-side) of fixing belt 5 slacks on the paper output side while the front side (F-side) of the belt slacks on the paper input side (FIG. 5C). This state is equivalent to a condition where the R-side and the F-side of fixing roller 3 are inclined in the nip portion, upstream and downstream, respectively with respect to the rotational direction of fixing belt 5, which causes fixing roller 3 to produce a force of pulling fixing belt 5 to the R-side so as to meander (move) fixing belt 5 to the R-side.

Figure 6:
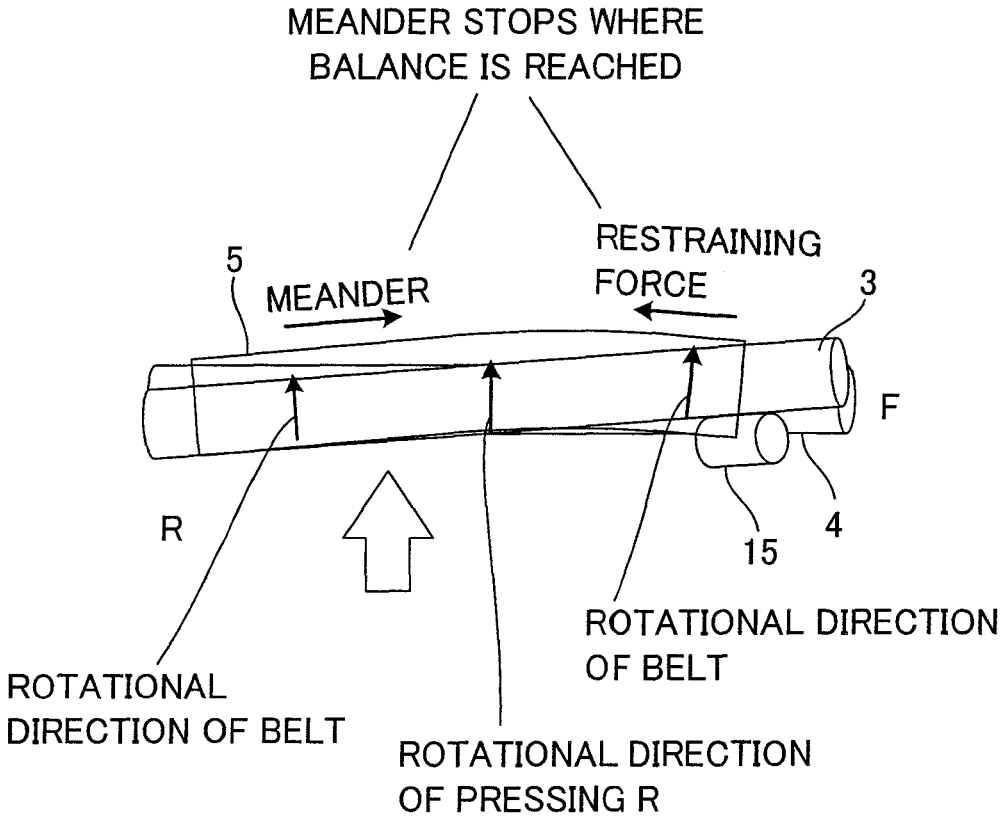
FIG. 6 is an illustrative view showing the function of meander regulating rollers when a fixing belt moves off to the F-side; and, FIG. 7 is a schematic view showing tapered, meander regulating rollers.

In this way, when fixing belt 5 moves off to the F-side of fixing roller 3 as shown in FIG. 6 the F-side end of fixing roller 3 is pressed on the paper input side, whereas when fixing belt moves off to the R-side of fixing roller 3, the R-side end of fixing roller 3 is pressed on the paper input side, whereby it is possible to restrain belt meandering. Accordingly, the pair of meander regulating rollers 15 arranged at both ends of the length of fixing roller 3 provide the meander regulation function as follows. That is, the side end of fixing belt 5 is held and pressed between fixing roller 3 and the meander regulating roller 15 located on the side to which fixing belt 5 is moving off. Then, due to the thickness of fixing belt 5, fixing roller 3 is displaced on the side where fixing belt 5 is being held, the area of contact with pressing roller 4 decreases, so does the rotational force transmitted from pressing roller 4 to fixing belt 5, thus acting a force of restraining the meandering on fixing belt 5.

Alternatively, the meander regulating rollers 15 arranged both ends of fixing roller 3 may be positioned so as to abut both side ends of the fixing belt, from the beginning. In this case, when the belt begins meandering, fixing belt 5 abuts one of meander regulating rollers 15 only, hence the same meander regulation effect as above can be obtained.

Figure 7:
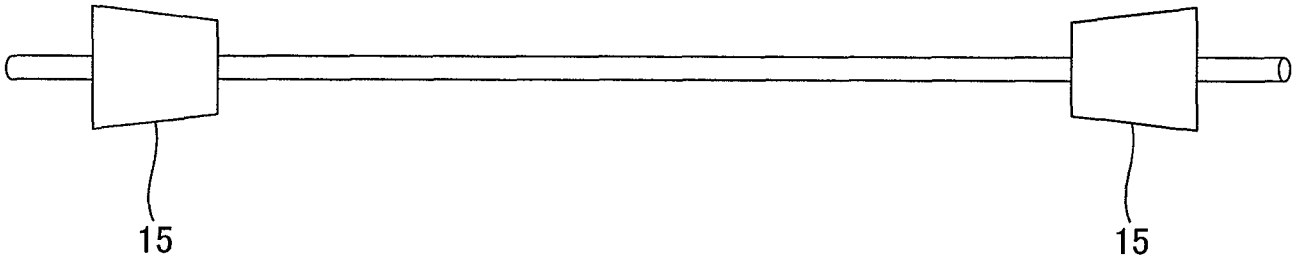

Here, as meander regulating roller 15 is pressed against fixing belt 5 in order to regulate belt meandering, the belt surface may warp near the area being pressed while the belt is rotating. If the meandering force is strong and the pressing force for meander regulation is strong, the belt surface may be wrinkled. This can be prevented by setting so that the load of meander regulating roller 15 acting on fixing belt 15 will change gently. To achieve this, meander regulating rollers 15 may be given in a tapered shape as shown in FIG. 7 so that the farther in the longitudinal direction the fixing belt moves off, the stronger the pressing force can be applied. As a result the warp of fixing belt 5 can be alleviated and the belt becomes unlikely to wrinkle.

As the embodiment of this invention has been detailed with reference to the drawings, the specific configuration should not be limited to this embodiment. Designs and others that do not depart from the gist of this invention should also be included in the scope of claims.

What is claimed is:

1. A fixing device comprising:

an endless fixing belt that is put in contact with a toner image on a fixed medium and fixes the toner image to the fixed medium;

a heat roller for heating the fixing belt;

a fixing roller that suspends the endless fixing belt between the heat roller and itself and has a silicone rubber layer that comes into pressing contact with the toner image on the fixed medium via the fixing belt;

a pressing roller that presses the fixing roller via the fixing belt; and a meander regulating member that presses the fixing belt against the fixing roller from the paper input side, at the side end of the fixing belt on the side to which the fixing belt is moved off with respect to the longitudinal direction of the fixing roller, wherein the fixing belt is configured to receive a rotational force only through a nip portion of the pressing roller, wherein the meander regulating member is disposed at either end of the fixing roller with respect to the longitudinal direction, so that at least one of the side ends of the fixing belt abut the meander regulating member, and wherein the meander regulating member is a rotatable roller having a counter-tapered shape that becomes wider as it goes to either axial end.

2. An image forming apparatus characterized by including the fixing device according to claim 1.

* * * * *